US008155808B2

(12) United States Patent
Tsai

(10) Patent No.: US 8,155,808 B2
(45) Date of Patent: Apr. 10, 2012

(54) SYSTEM FOR MONITORING TRACK TRANSPORTATION

(75) Inventor: Hong-I Tsai, Taipei (TW)

(73) Assignee: Taiwan Nano-Technology Application Corp., Hsinchu (TW)

( * ) Notice: Subject to any disclaimer, the term of this patent is extended or adjusted under 35 U.S.C. 154(b) by 598 days.

(21) Appl. No.: 12/385,177

(22) Filed: Apr. 1, 2009

(65) Prior Publication Data

US 2010/0252692 A1 Oct. 7, 2010

(51) Int. Cl.
*G06F 17/00* (2006.01)
*B61L 23/00* (2006.01)

(52) U.S. Cl. ..... 701/19; 246/1 C

(58) Field of Classification Search ..... 701/19, 701/20, 29.7–31.1, 31.9; 246/1 R, 1 C, 26, 246/201, 297, 322; 702/1
See application file for complete search history.

(56) References Cited

U.S. PATENT DOCUMENTS 5,275,051 A * 1/1994 De Beer ..... 73/598
5,579,013 A 11/1996 Hershey et al.
6,860,453 B2 3/2005 Moretti et al.
2004/0122569 A1* 6/2004 Bidaud ..... 701/19
2006/0261218 A1* 11/2006 Mace et al. ..... 246/169 R
2007/0163352 A1* 7/2007 Nielsen et al. ..... 73/668
2008/0011091 A1* 1/2008 Weldon, Jr. ..... 73/766
2008/0234964 A1* 9/2008 Miyasaka et al. ..... 702/113

* cited by examiner

*Primary Examiner* — Mary Cheung

(57) ABSTRACT

A system for monitoring track transportation to determine an abnormal status of a track is disclosed. The system includes at least one sensing module arranged at a predetermined monitoring point of the track, and each sensing module includes at least one force sensing unit and vibration sensing unit. A track status signal processing circuit is electrically connected to the sensing module for receiving the time domain force-related signal and time domain vibration-related signal, and these signals are converted to the digital signals. The digital signals are transferred to a signal calculating and processing unit, which includes a time domain/frequency domain force-related signal converting circuit, a time domain/frequency domain vibration-related signal converting circuit, and a frequency response function calculating unit. The frequency response function calculating unit divides the frequency domain vibration-related signal into frequency domain force-related signal to generate an input-output response frequency spectrum signal for determining an abnormal status of the track.

13 Claims, 11 Drawing Sheets

SYSTEM FOR MONITORING TRACK TRANSPORTATION

FIELD OF THE INVENTION

The present invention relates to a monitoring technology for safety of track transportation, and more particularly to such a system for monitoring track transportation.

BACKGROUND OF THE INVENTION

A conventional method to maintain the track system is through regular and highly concentrated maintenance manpower. In this way, it not only has defects such as consuming of manpower and materials, but also is unreliable. However, it has a tendency to increase the personal negligence, and lead to a potential accident.

In order to improve the defects of the conventional method mentioned above, there are various monitoring applications in prior art, but these applications still can not completely attain the requirements of track transportation safety so far.

For track transportation safety, in addition to maintain normal operation of the electromechanical system, whether structure of track has abnormal status in long term operation is also very important. Due to property of track transportation, after train-intensive and frequent vibration, even a loose bolt, slight material fatigue, artificial damages, defect welding, false welding . . . etc. may cause serious accidents. The conventional method to maintain the track system is through regular and highly concentrated maintenance manpower. In this way, it not only has defects such as consuming of manpower and materials, but also is unreliable. Therefore, it has a tendency to increase the personal negligence, and lead to a potential accident.

If an intelligent track transportation monitoring system can be provided, whose design is based on integrating an aspect of track safety maintenance in construction and building structure into electromechanical system and distal monitoring system, so that track structure status can be monitored and accidents caused by artificial error also can be prevented.

SUMMARY OF THE INVENTION

It is an object of the present invention to provide a system for monitoring track transportation, the system is adapted to monitor monitoring dynamic signals of several points at the track by means of several sensing modules arranged at the predetermined points at the track, and thus determine the abnormal status for the track.

To achieve the above and other objects, the present invention provides a system for monitoring track transportation. The system includes at least one sensing module arranged at a predetermined monitoring point of the track, and each sensing module includes at least one force sensing unit and vibration sensing unit. A track status signal processing circuit is electrically connected to the sensing module for receiving the time domain force-related signal and time domain vibration-related signal, and these signals are converted to the digital signals. The digital signals are transferred to a signal calculating and processing unit, which includes a time domain/frequency domain force-related signal converting circuit, a time domain/frequency domain vibration-related signal converting circuit, and a frequency response function calculating unit. The frequency response function calculating unit divides the frequency domain vibration-related signal into frequency domain force-related signal to generate an input-output response frequency spectrum signal for determining an abnormal status of the track.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
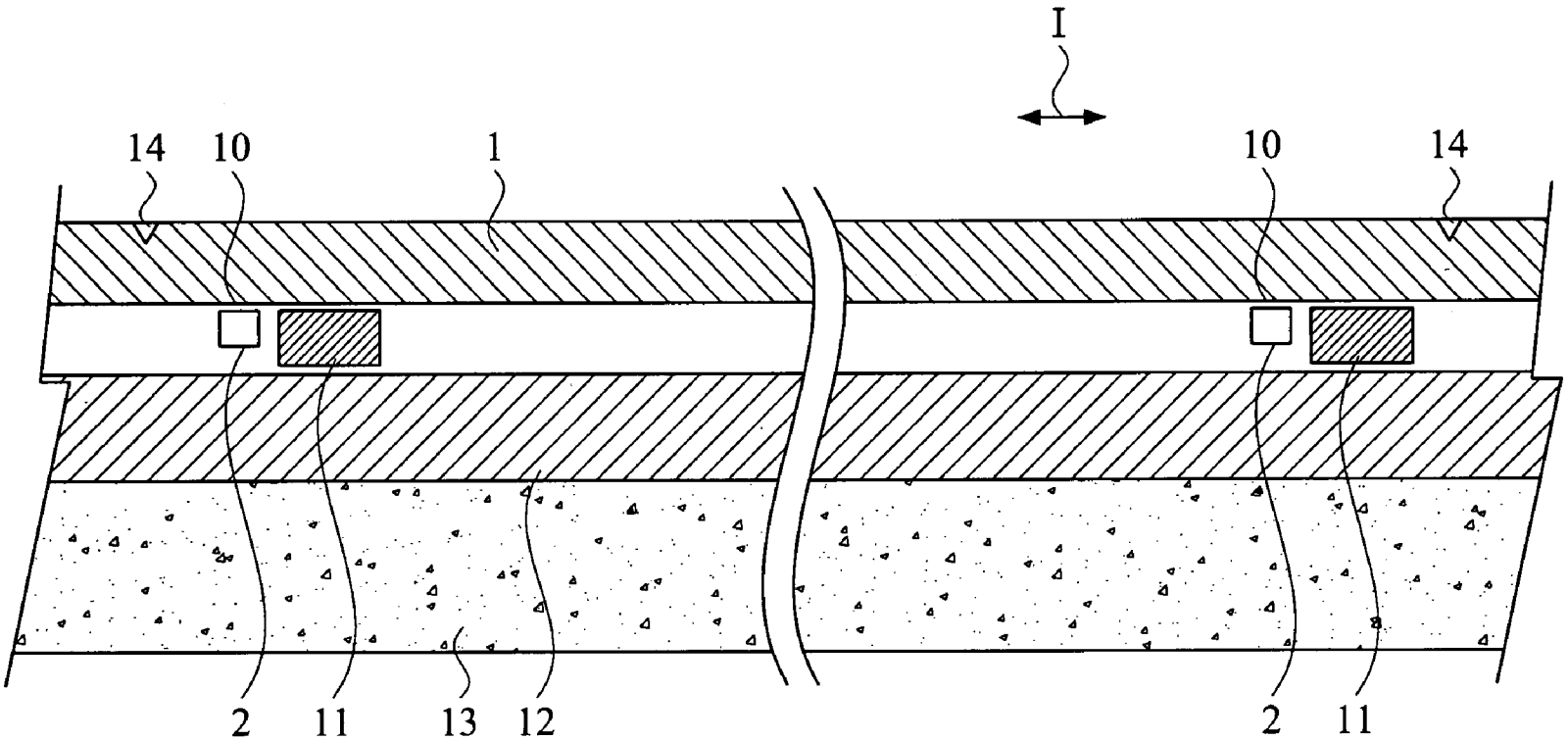
FIG. 1 is a schematic diagram of a track of the present invention.

FIG. 1 illustrates that a track 1 is arranged on ballast 12 set on a base 13 through several railroad ties 11, so as to let the track 1 steadily set on ballast 12 in an extending direction I. The present invention comprises a plurality of sensing modules 2, and each sensing module 2 is arranged at a predetermined monitoring point 10 of the track with an equal distance from each other. The predetermined monitoring point 10 can be arranged at the track 1 or at a welding point 14 under the track 1 with an equal or unequal distance from each other.

Figure 2:
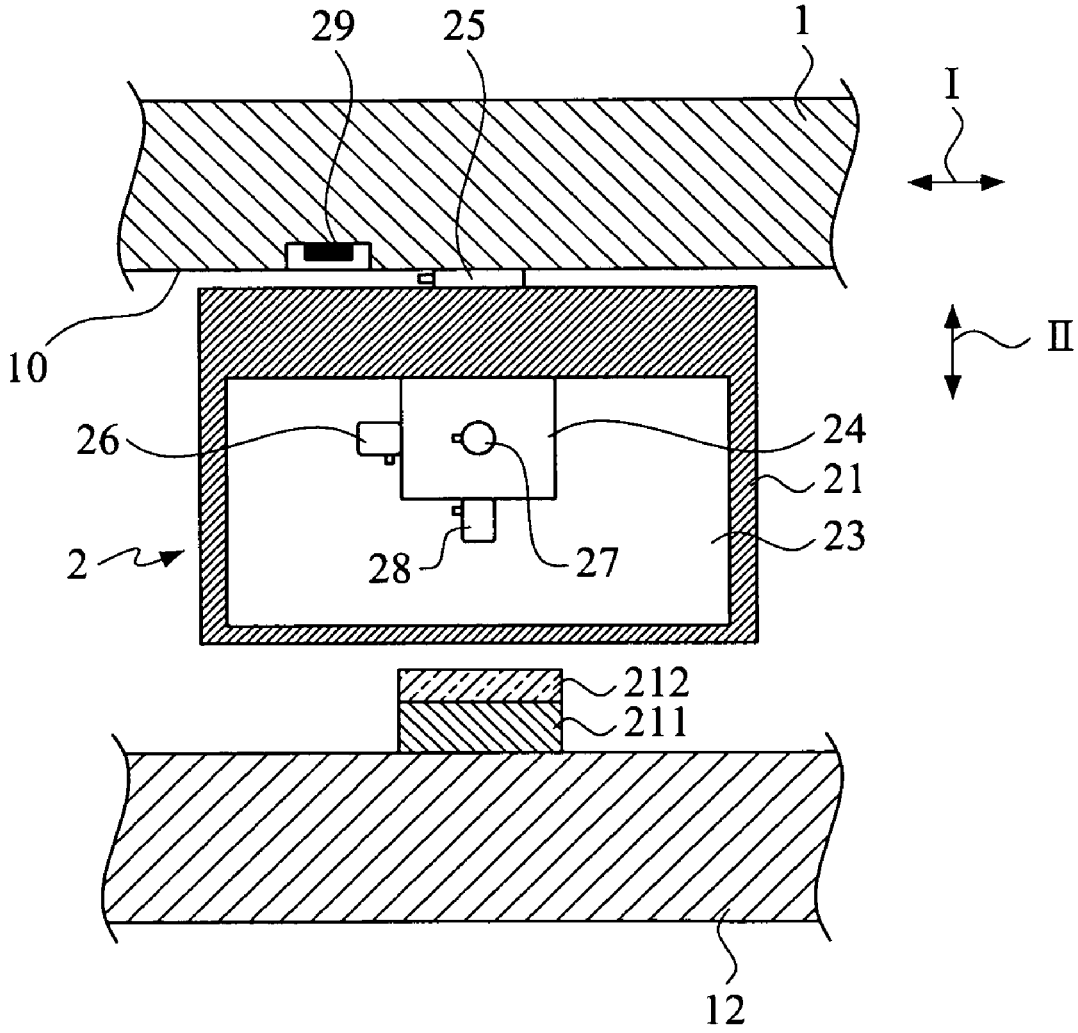
FIG. 2 is a sectional diagram of a sensing module according to the first embodiment of the present invention.
Figure 3:
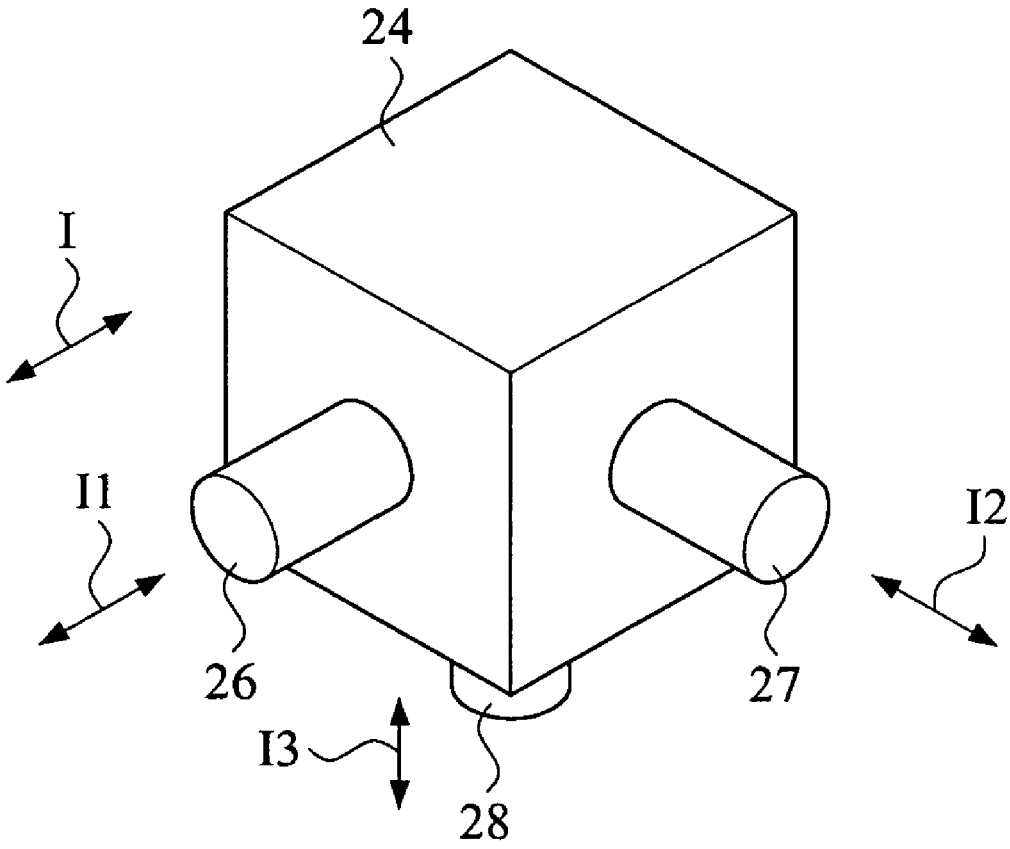
FIG. 3 is an assembly diagram of a sensing module of the present invention.
Figure 4:
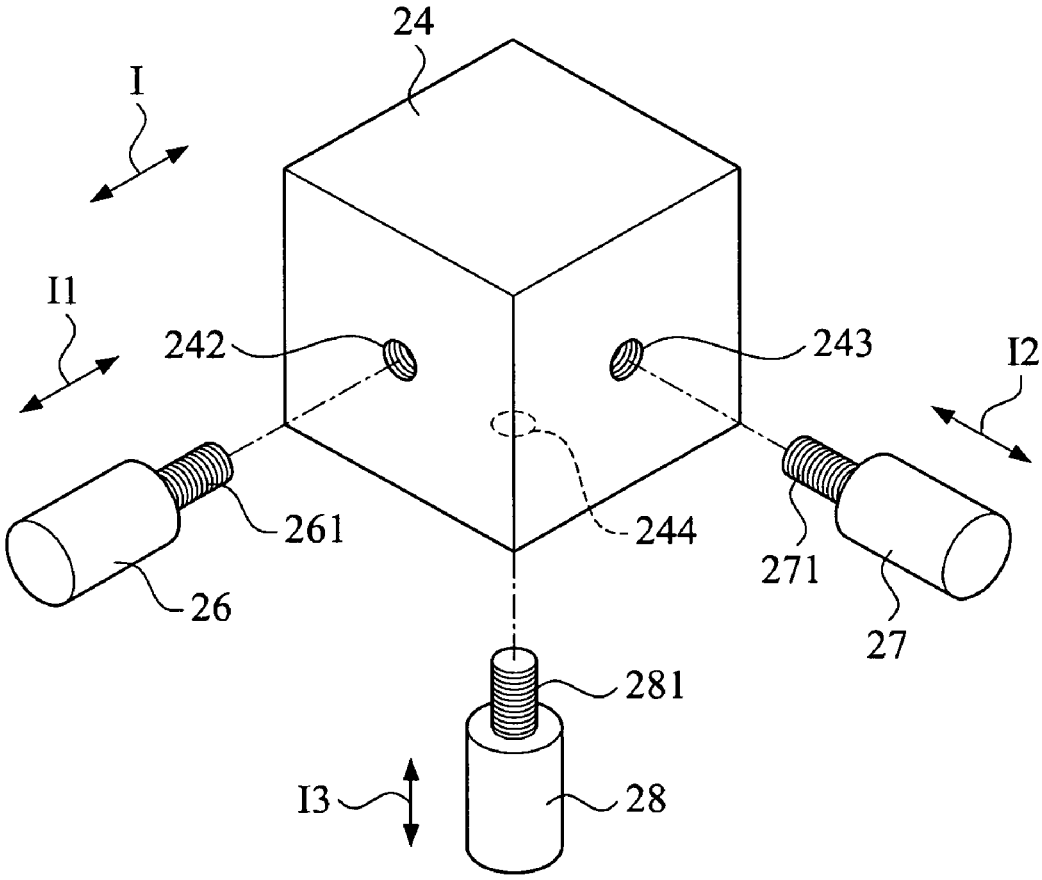
FIG. 4 is an exploded diagram of a sensing module of the present invention.

FIG. 2 illustrates a sectional view of the sensing module 2 according to a first embodiment of the present invention. In addition, please refer to the FIG. 3 and FIG. 4 simultaneously. The sensing module 2 comprises an anti-electromagnetic interference, waterproof, allowing ventilation outer housing 21. The outer housing 21 is fixed at the track 1 by means such as bolts, welding, or epoxy resins to attach on a lower edge of the track 1.

An inner space 23 is formed inside the outer housing 21, so as to accommodate a square 24. A force sensing unit 25 is arranged between the apical side of the outer housing 21 and the track 1. The force sensing unit 25 can detect a force signal in a force direction II, and the signal is generated from a vehicle passing through the predetermined monitoring point 10 of the track 1 that force sensing unit 25 being arranged.

The sensing module 2 of the present invention comprises a first axis direction vibration sensing unit 26, a second axis direction vibration sensing unit 27, and a third axis direction vibration sensing unit 28, and each one is screwed to the bolt holes 242, 243, and 244 of the lateral side of the square 24 through the bolts 261, 271, and 281 respectively. Preferably the first axis direction vibration sensing unit 26, the second axis direction vibration sensing unit 27, and the third axis direction vibration sensing unit 28 are acceleration sensors, or can be conventional vibration sensors.

The first axis direction vibration sensing unit 26 is attached to the sensing module 2 in a first axis direction, namely, whose force axis I1 is parallel to the extending direction I of the track 1, so that it can detect a vibration signal parallel to the extending direction I and generated from a vehicle passing through the predetermined monitoring point of the track 1 that the first axis direction vibration sensing unit 26 being arranged.

The second axis direction vibration sensing unit 27 is attached to the sensing module 2 in a second axis direction, namely, whose force axis 12 is horizontally perpendicular to the extending direction I of the track 1, so that it can detect a vibration signal perpendicular to the extending direction I and generated from a vehicle passing through the predetermined monitoring point of the track 1 that the second axis direction vibration sensing unit 27 being arranged.

The third axis direction vibration sensing unit 28 is attached to the sensing module 2 in a third axis direction, namely, whose force axis I3 is perpendicular to the extending direction I of the track 1, so that it can detect a vibration signal perpendicular to the extending direction I and generated from a vehicle passing through the predetermined monitoring point of the track 1 that the third axis direction vibration sensing unit 28 being arranged.

A space is formed between the apical side of the outer housing 21 and the lower edge of the track 1, so as to accommodate a strain sensor 29 on the lower edge of the track 1. The strain sensor 29 is specialized in low frequency signal response, so that it can detect a strain signal of the vehicle that passes through the predetermined monitoring point of the strain sensor being arranged. The position of the strain sensor 29 depends on the actual requirement, for example, the strain sensor can be installed in the sensing module arranged at the welding point, and the other sensing modules merely install force sensing units and vibration sensing units. The strain signals of the strain sensor 29 can be one of the vibration signals.

A block 211 is arranged between the bottom of the outer housing 21 and the ballast 12. Preferably, a cushion layer 212 is attached on the topical side of the block 211, to be a cushion material between the block 211 and the cushion layer 212. When the vehicle passes through the location where the sensing module 2 arranged, the bottom of the outer housing 21 presses the cushion layer 212 of the block 211, the force sensor 25 is pressed, and then the force sensor 25 generates a force signal.

Figure 5:
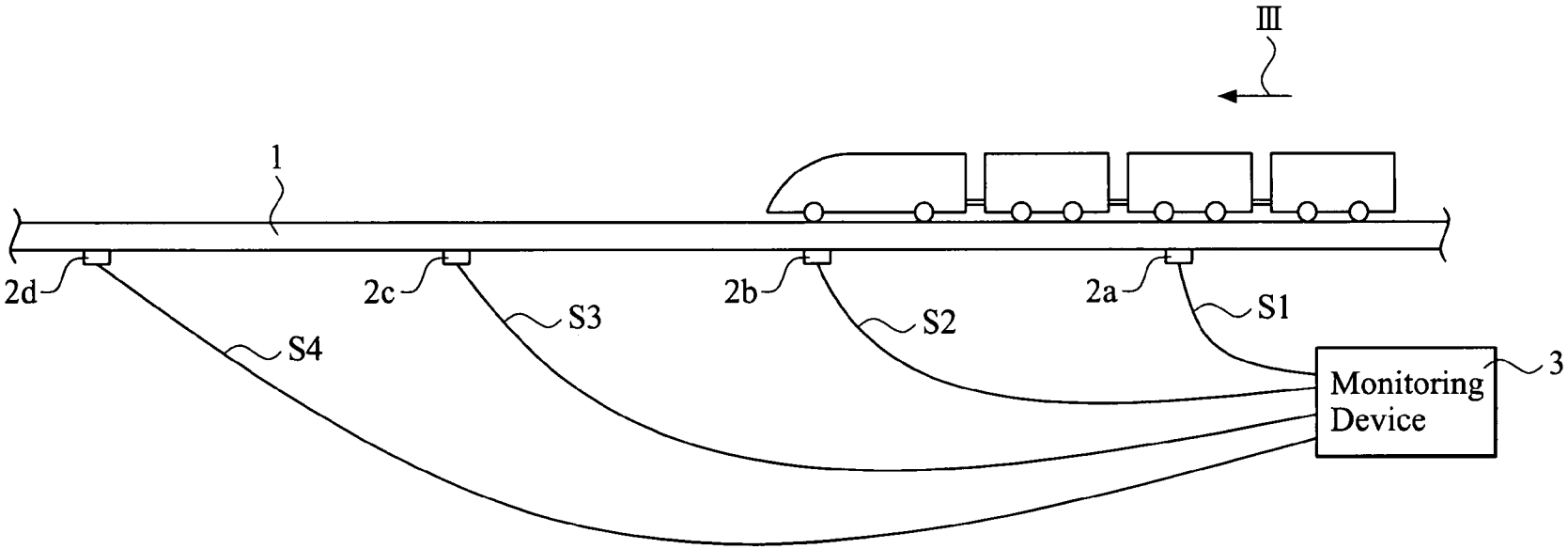
FIG. 5 is a schematic diagram of a system of the present invention.

Please refer to FIG. 5, just as the sensing module 2 mentioned above. When the sensing modules 2*a*, 2*b*, 2*c*, and 2*d* are completely arranged at the track, connect the sensing modules 2*a*, 2*b*, 2*c*, and 2*d* with a monitoring device through the signal cables. When the vehicle drives along the track 1 in a driving direction III, it is available to acquire the signals that the sensing modules 2*a*, 2*b*, 2*c*, and 2*d* transferring to the monitoring device 3 via the signal cables, and these signals includes the dynamic signals s1, s2, s3, and s4 of force signals, vibration signals, and strain signals. After receiving and analyzing the dynamic signals s1, s2, s3, and s4, the monitoring device 3 converts the dynamic signals s1, s2, s3, and s4 to monitoring parameters, so as to convert complicated data into useful information to help engineers to determine a status of track safety. The monitoring device 3 can be set in the distal central control center, so that it may reach the goal for distal monitoring of track safety.

Figure 6:
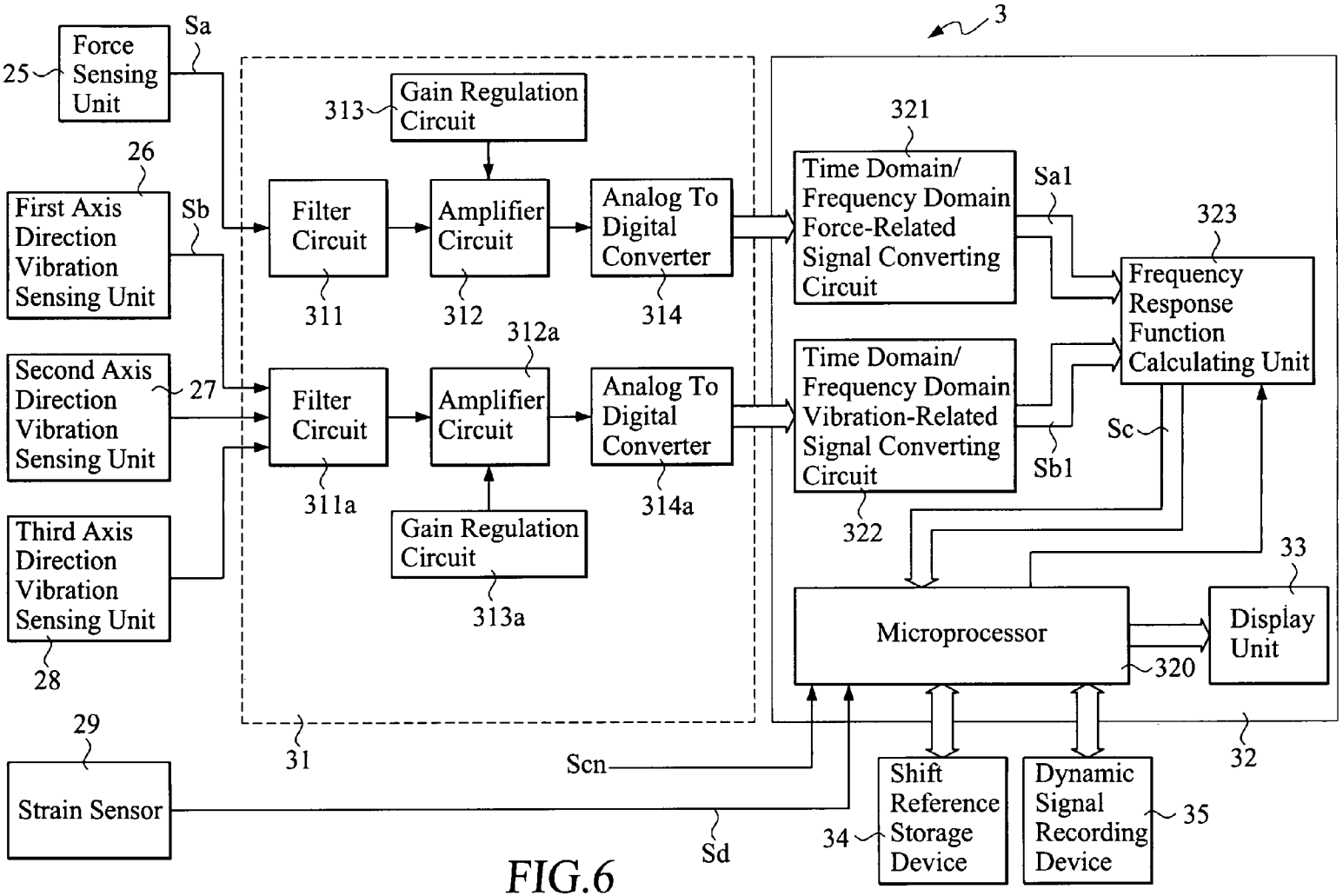
FIG. 6 is a further circuit diagram of a monitoring device of FIG. 5.
Figure 7:
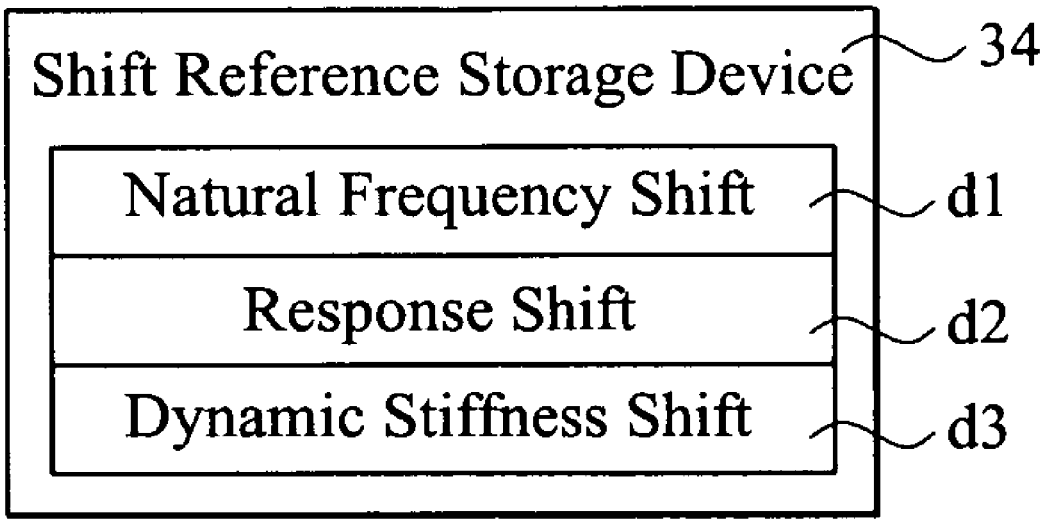
FIG. 7 is a block diagram of a shift reference storage device of FIG. 6.

FIG. 6 is a further electric circuit diagram of the monitoring device 3 of FIG. 5, and FIG. 7 is a block diagram that illustrates the shift reference storage device in FIG. 6, and the device stores the natural frequency shift, response shift and dynamic stiffness shift.

As shown in FIG. 6, each sensing module 3 includes a force sensing unit 25 and three vibration sensing units 26, 27, and 28. The force sensing unit 25 is adapted to detect force signals generated from a vehicle passing through the predetermined monitoring point of the track where the force sensing unit 25 being arranged, and accordingly generates a time domain force-related signal Sa. The vibration sensing units 26, 27, and 28 are adapted to detect vibration signals generated from a vehicle passing through a predetermined monitoring point of the track where the vibration sensing unit 26, 27, and 28 being arranged respectively, and accordingly generates the time domain vibration-related signal Sb.

A track status signal processing circuit 31 is electrically connected to the force sensing unit 25 and the vibration sensing units 26, 27, and 28 of the sensing module, so as to receive and process the time domain force-related signal Sa detected by the force sensing unit. Similarly, track status signal processing circuit 31 is also adapted to receive and process the time domain vibration-related signal Sb detected by the vibration sensing unit.

The circuit of the track status signal processing circuit 31 for processing the force sensing unit 25 comprises a filter circuit 311, an amplifier circuit 312, a gain regulation circuit 313, and an analog to digital converter 314. The filter circuit 311 is electrically connected to the force sensing unit 25 and configured to filter the time domain force-related signal detected by the force sensing unit 25. The amplifier circuit 312 is electrically connected to the filter circuit 311 and configured to amplify the filtered time domain force-related signal. The gain regulation circuit 313 is adapted to regulate the gain value of the amplifier circuit 312. The analog to digital converter 314 is electrically connected to the amplifier circuit 312 and configured to convert the time domain force-related signal being filtered and amplified to a digital time domain force-related signal.

The circuit of the track status signal processing circuit 31 for processing the vibration sensing units 26, 27, and 28 comprises a filter circuit 311*a*, an amplifier circuit 312*a*, a gain regulation circuit 313*a*, and an analog to digital converter 314*a*. The filter circuit 311*a* is electrically connected to the vibration sensing units 26, 27, and 28 and configured to filter the time domain vibration-related signals Sb detected by the the vibration sensing units 26, 27, and 28. The amplifier circuit 312a is electrically connected to the filter circuit 311*a*, so as to amplify the filtered time domain vibration-related signals. The gain regulation circuit 313*a* is adapted to regulate the gain value of the amplifier circuit 312*a*. The analog to digital converter 314*a* is electrically connected to the amplifier circuit 312*a*, so as to convert the time domain vibration-related signals being filtered and amplified to digital time domain vibration-related signals.

A signal calculating and processing unit 32 is electrically connected to the track status signal processing circuit 31, adapted to receive the signals generated from the track status signal processing circuit 31. The signal calculating and processing unit 32 comprises a time domain/frequency domain force-related signal converting circuit 321, a time domain/frequency domain vibration-related, signal converting circuit 322, and a frequency response function calculating unit 323. The time domain/frequency domain force-related signal converting circuit 321 can receive the digital time domain force-related signal transferred from the track status signal processing circuit 31, so as to convert the signal to a frequency domain force-related signal Sa1. The time domain/frequency domain vibration-related signal converting circuit 322 can receive the digital time domain vibration-related signal transferred from track status signal processing circuit, so as to convert the signal to a frequency domain vibration-related signal Sb1. The frequency response function calculating unit 323 can receive the frequency domain force-related signal Sa1 generated from the time domain/frequency domain force-related signal converting circuit 321 and the frequency domain vibration-related signal Sb1 generated from the time domain/frequency domain vibration-related signal converting circuit 322, so as to generate an input-output response frequency spectrum signal Sc.

The signal calculating and processing unit 32 comprises a microprocessor 320. The microprocessor 320 is electrically connected with a shift reference storage device 34 for storing at least a predetermined shift reference. The shift reference comprises a natural frequency Shift d1, a response shift d2 and a dynamic stiffness shift d3 (as shown in FIG. 7). In addition, the microprocessor 320 is further electrically connected with a display unit 320 for displaying related information.

The signal calculating and processing unit 32 can compare the input-output response frequency spectrum signal Sc with a natural frequency Scn, so as to acquire the dynamic signal of the predetermined monitoring point of the track, and accordingly determine an abnormal situation for the track.

The signal calculating and processing unit 32 is electrically connected to a dynamic signal recording device 35, so as to record the force signal detected by the force sensing unit 25, the vibration signal detected by the vibration sensing units 26, 27, and 28, and the input-output response frequency spectrum signal generated from the frequency response function calculating unit.

The signal calculating and processing unit 32 is further connected with a strain sensor 29, so that it can detect a strain signal Sd of the vehicle that passes through the predetermined monitoring point of the strain sensor being arranged, and determine the track status according to the strain signal Sd.

Via the Fast Fourier Transform, the time domain signal detected by the force sensing unit and vibration sensing unit of each sensing module can be converted to an input-output response frequency spectrum regarding to a specific location of the track. In addition, the force sensing unit can set up a trigger signal. Once the force signal detected by the force sensing unit is over the default trigger level, then the monitoring device acquires the signal and records the frequency response.

Since the force signals generated from vehicles passing through the monitoring point of the track everyday can be acquired constantly, a database for track safety can be established through accumulating these signals. Thus the database can be used to provide a reference of track safety for maintenance staffs and engineers.

Figure 8A:
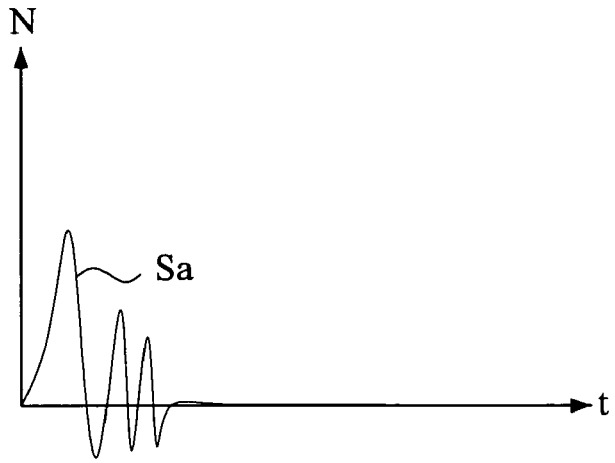
FIG. 8A is a waveform diagram of a time domain force-related signal detected by the force sensing unit of the sensing module.
Figure 8B:
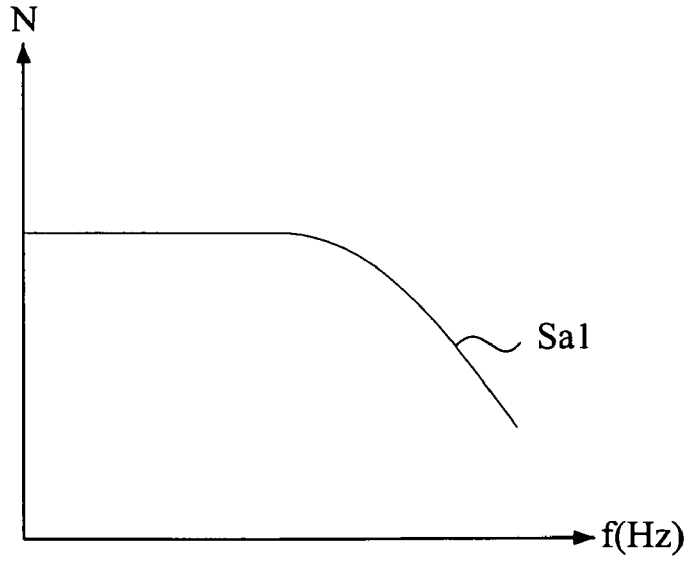
FIG. 8B is a waveform diagram of a frequency domain force-related signal converted from time domain force-related signal of FIG. 8A.

FIG. 8A is a waveform diagram of a time domain force-related signal detected by the force sensing unit of the sensing module. The longitudinal coordinate of the time domain force-related signal Sa represents time t(second), and the horizontal coordinate represents force N(Newton). After transferring to the monitoring device 3, the time domain force-related signal Sa can be converted to the frequency domain force-related signal Sa1. FIG. 8B is a waveform diagram of the frequency domain force-related signal, so as to demonstrate the time domain force-related signal converted to the frequency domain force-related signal Sa1. The horizontal coordinate represents frequency f(Hz), and the longitudinal coordinate represents force N(Newton).

Figure 9A:
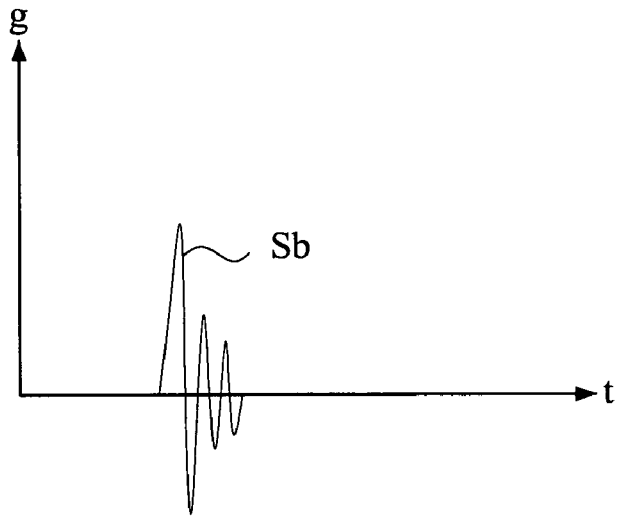
FIG. 9A is a waveform diagram of a time domain vibration-related signal detected by the vibration sensing unit of the sensing module.
Figure 9B:
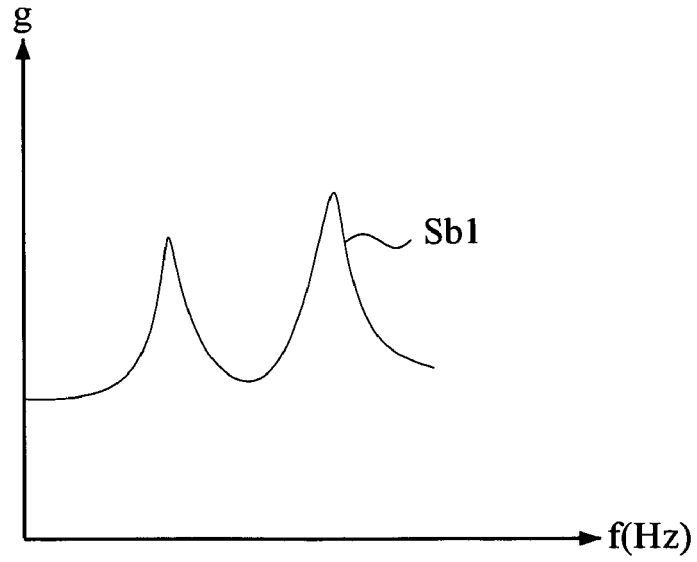
FIG. 9B is a waveform diagram of a frequency domain vibration-related signal converted from frequency domain vibration-related signal of FIG. 9A.

FIG. 9A is a waveform diagram of the time domain vibration-related signal detected by the vibration sensing unit of the sensing module. The horizontal coordinate represents time t(second), and the longitudinal coordinate represents acceleration g. After transferring to the monitoring device 3, the time domain vibration-related signal Sb can be converted to the frequency domain force-related signal Sb1. FIG. 9B is a waveform diagram of the frequency domain vibration-related signal Sb1, so as to demonstrate the time domain vibration-related signal converted to the vibration frequency signal Sa1. The horizontal coordinate represents frequency f(Hz), and the longitudinal coordinate represents acceleration g.

Figure 10:
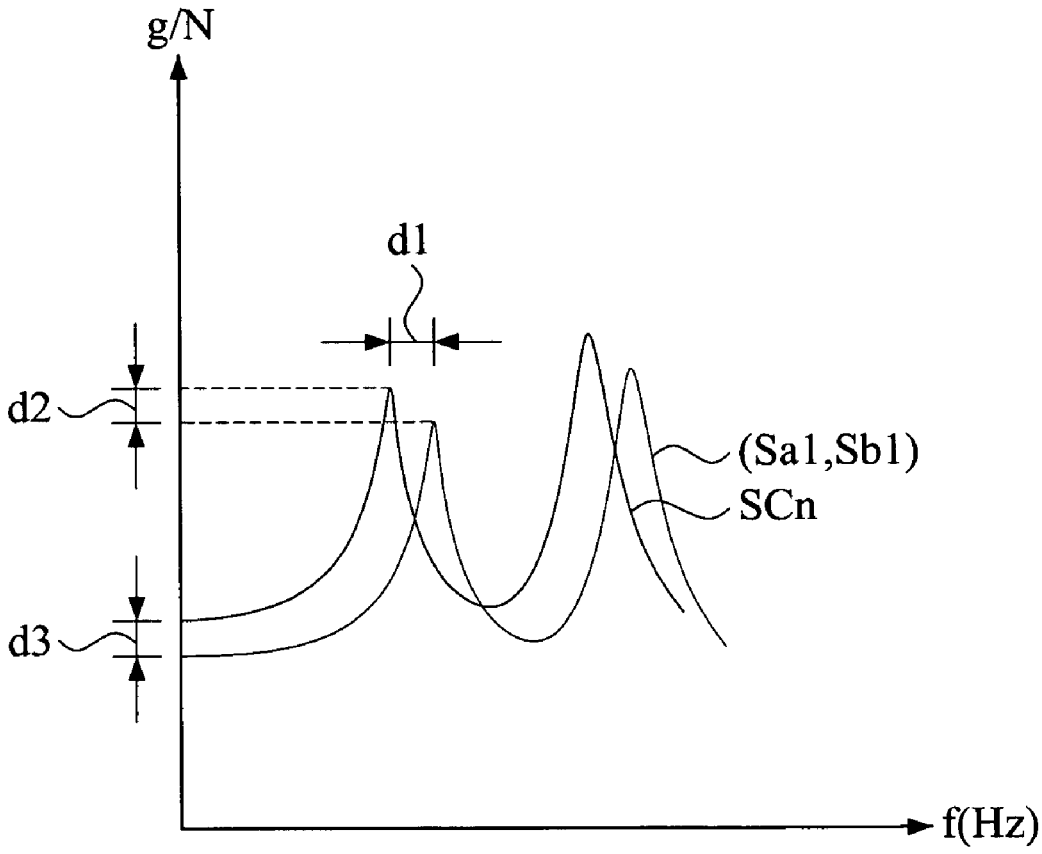
FIG. 10 is a waveform diagram of an input-output response frequency spectrum signal.

FIG. 10 is a waveform diagram to demonstrate the input-output response frequency spectrum signal Sc according to the frequency domain vibration-related signal of FIG. 9B divided by the frequency domain force-related signal of FIG. 8. The diagram also demonstrates the waveform of the natural frequency Scn responding to the predetermined monitoring point.

The parameters provided by response spectrum as shown in FIG. 10 includes a natural frequency for a predetermined location, a response value according to the natural frequency, and a dynamic stiffness of the track . . . etc. The dynamic stiffness of the track can be obtained by calculating the reciprocal of double integral of the response spectrum (acceleration), and calculating a response average of a flat frequency interval taken from a low frequency to the first natural frequency. These parameters and the shift d1 of natural frequency Scn can simultaneously be the indicators to evaluate whether a track is having metal fatigue. Monitor of the natural frequency Scn is not limited to the first natural frequency, it can depend on property of track system to specifically monitor other high-level natural frequency.

The response spectrum as shown in FIG. 10 demonstrates that the monitoring parameter comprises a natural frequency shift d1, response shift d2 and dynamic stiffness shift d3 of the track.

Generally speaking, when natural frequency shifts downward, response of natural frequency raises, or dynamic stiffness decreases, which may be an alarm for a track having metal fatigue, so that we may set up an alarm value to record the safety status of the track system. System for track transportation of the present invention can set up shift alarm values of natural frequency, frequency response and dynamic stiffness according to actual requirements.

Figure 11:
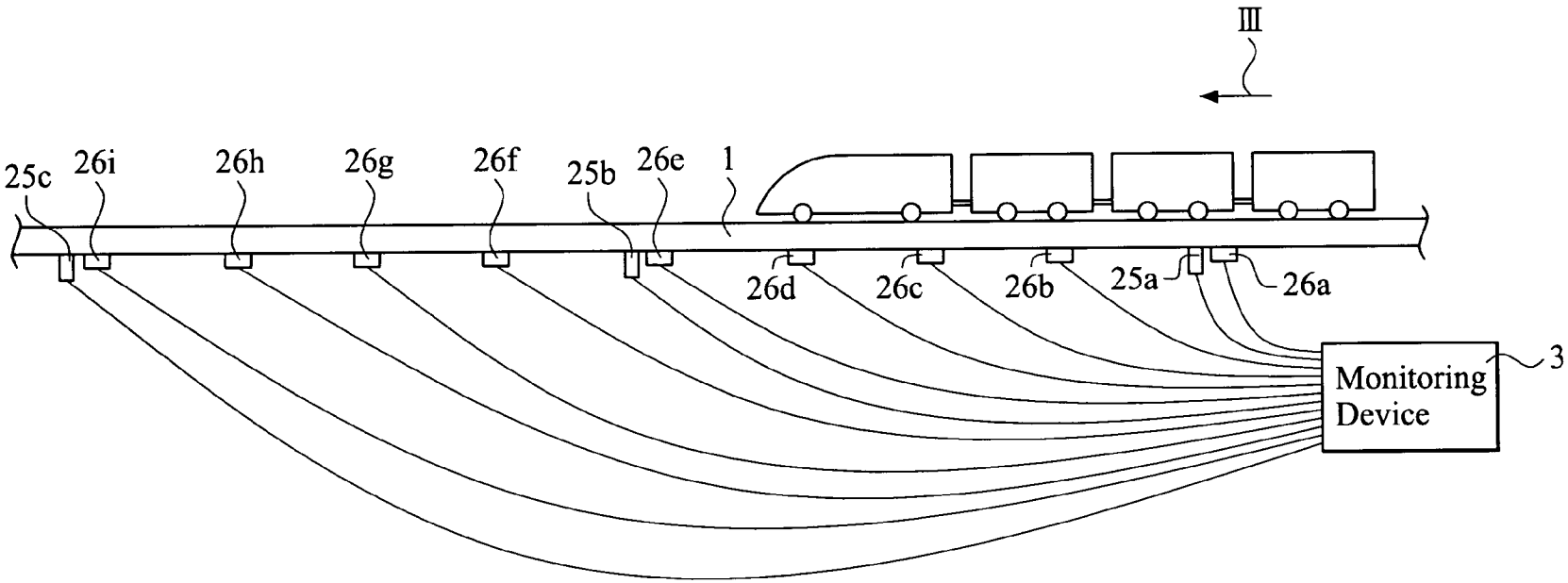
FIG. 11 is a schematic diagram of a track arranged several force sensing units with equal predetermined distances, and also arranged several vibration sensing units with different distances.

According to the embodiment in FIG. 5, the sensing modules 2*a*, 2*b*, 2*c*, and 2*d* are arranged in an equal distance from each other or set at the predetermined locations. In practice, the sensing modules also can be dispersedly arranged at the predetermined locations of track. As shown in FIG. 11, the track arranges several force sensing units 25*a*, 25*b*, and 25*c* with equal predetermined distances, and also arranges several vibration sensing units 26*a*, 26*b*, and 26*c* with different distances. The force sensing units 25*a*, 25*b*, and 25*c* and the vibration sensing units 26*a*, 26*b*, 26*c*, 26*d*, 26*e*, 26*f*, 26*g*, 26*h*, and 26*i* connect with the monitoring device 3 via signal cables separately. When the vehicle drives along the track 1 in a driving direction III, the force signals can be acquired by the force sensing units 25*a*, 25*b*, and 25*c*, and the vibration signals can be detected by the vibration sensing units 26*a*, 26*b*, 26*c*, 26*d*, 26*e*, 26*f*, 26*g*, 26*h*, and 26*i*, so as to determine a Mode Shape of the track.

Although the present invention has been described with reference to the preferred embodiments thereof and the best modes for carrying out the present invention, it is apparent to those skilled in the art that a variety of modifications and changes may be made without departing from the scope of the present invention which is intended to be defined by the appended claims.

What is claimed is:

1. A system for monitoring a track transportation, comprising:

at least one sensing module arranged at a predetermined monitoring point of the track, each sensing module comprising:

at least one force sensing unit for detecting a force signal generated from a vehicle passing through a predetermined monitoring point of the track where the force sensing unit being arranged, and accordingly generating a time domain force-related signal;

at least one vibration sensing unit for detecting a vibration signal generated from a vehicle passing through a predetermined monitoring point of the track where the vibration sensing unit being arranged, and accordingly generating a time domain vibration-related signal;

a track status signal processing circuit electrically connected to the sensing module for receiving the time domain force-related signal detected by the force sensing unit so as to convert to a digital frequency domain force-related signal, and receiving the time domain vibration-related signal detected by the vibration sensing unit so as to convert to a digital frequency domain vibration-related signal; and a signal calculating and processing unit electrically connected to the track status signal processing circuit for receiving the frequency domain force-related signal detected by the force sensing unit and the frequency domain vibration-related signal detected by the vibration sensing unit so as to convert to an input-output response frequency spectrum signal.

2. The system as claimed in claim 1, wherein the signal calculating and processing unit comprises:

a time domain/frequency domain force-related signal converting circuit for receiving the digital time domain force-related signal transferred from track status signal processing circuit, so as to convert to a frequency domain force-related signal;

a time domain/frequency domain vibration-related signal converting circuit for receiving the digital time domain vibration-related signal transferred from track status signal processing circuit, so as to convert to a frequency domain vibration-related signal; and a frequency response function calculating unit for receiving the frequency domain force-related signal generated from the time domain/frequency domain force-related signal converting circuit and the frequency domain vibration-related signal generated from the time domain/frequency domain vibration-related signal converting circuit, so as to generate an input-output response frequency spectrum signal.

3. The system as claimed in claim 1, wherein the signal calculating and processing unit is further connected to a shift reference storage device for storing a predetermined shift reference, and the predetermined shift reference comprises a natural frequency shift, response shift and dynamic stiffness shift.

4. The system as claimed in claim 1, wherein the signal calculating and processing unit further comprises a dynamic signal recording device for recording the frequency domain force-related signal, the frequency vibration-related signal, and the input-output response frequency spectrum signal generated from the frequency response function calculating unit.

5. The system as claimed in claim 1, wherein the vibration sensing unit comprises an acceleration sensing unit, and the time domain vibration-related signal generated from the acceleration sensing unit is an acceleration time domain signal.

6. The system as claimed in claim 1, wherein the force axis of the force sensing unit is perpendicular to an extending direction of the track, so as to detect the time domain force-related signal of the track applied a vertical force.

7. The system as claimed in claim 1, wherein the vibration sensing unit comprises a first axis direction vibration sensing unit attached to the sensing module in a first axis direction, and the force axis of the first axis direction vibration sensing unit is parallel to the extending direction of the track.

8. The system as claimed in claim 7, wherein the vibration sensing unit further comprises a second axis direction vibration sensing unit attached to the sensing module in a second axis direction, and the force axis of the second axis direction vibration sensing unit is horizontally perpendicular to the extending direction of the track.

9. The system as claimed in claim 8, wherein the vibration sensing unit further comprises a third axis direction vibration sensing unit attached to the sensing module in a third axis direction, and the force axis of the third axis direction vibration sensing unit is perpendicular to the extending direction of the track.

10. The system as claimed in claim 1, wherein the signal calculating and processing unit is further connected to a strain sensor, so as to detect a strain signal of the vehicle that passes through the predetermined monitoring point of the strain sensor being arranged.

11. The system as claimed in claim 1, wherein each sensor module is arranged at the predetermined monitoring point of the track with a predetermined distance from each other.

12. The system as claimed in claim 1, wherein the track status signal processing circuit comprises:

a filter circuit electrically connected to the sensing module and configured to filter the time domain force-related signal detected by the force sensing unit and the time domain vibration-related signal detected by the vibration sensing unit;

an amplifier circuit electrically connected to the filter circuit and configured to amplify the time domain force-related signal being filtered, and amplify the time domain vibration-related signal being filtered; and an analog to digital converter electrically connected to the amplifier circuit and configured to convert the time domain force-related signal being filtered and amplified to a digital time domain force-related signal, and convert the time domain vibration-related signal being filtered and amplified to a digital time domain vibration-related signal.

13. The system as claimed in claim 12, wherein the track status signal processing circuit further comprises a gain regulation circuit electrically connected to the amplifier circuit, so as to regulate a gain value of the amplifier circuit.

* * * * *